United States Patent [19]

Rose

[11] Patent Number: 4,461,439

[45] Date of Patent: Jul. 24, 1984

[54] APPLIANCE HOLDER

[76] Inventor: Thomas C. Rose, P.O. Box 13191, Charlotte, N.C. 28226

[21] Appl. No.: 297,716

[22] Filed: Aug. 31, 1981

[51] Int. Cl.[3] ..... F16L 3/00

[52] U.S. Cl. ..... 248/51; 248/288.3; 248/314; 248/316.6; 403/90; 403/141

[58] Field of Search ..... 248/663, 316 C, 288.3, 248/224.3, 288.5, 102, 103, 104, 105, 106, 107, 205.2, 289.1, 290, 221.3, 51, 314; 403/90, 141

[56] References Cited

U.S. PATENT DOCUMENTS

| | | | |
|---|---|---|---|
| 908,751 | 1/1909 | Cooke | 248/276 X |
| 1,300,863 | 4/1919 | Otte | 248/276 X |
| 1,329,816 | 2/1920 | Winslow | 248/103 |
| 1,333,616 | 3/1920 | Hall et al. | 248/201 X |
| 1,624,695 | 4/1927 | Tufenkjian | 248/103 |
| 1,837,991 | 12/1931 | Ovington | 211/69.6 |
| 2,029,532 | 2/1936 | Karcher | 248/276 X |
| 2,810,555 | 10/1957 | Rockey | 248/224.3 X |
| 3,197,032 | 7/1965 | Stanley | 248/289.1 X |
| 3,843,083 | 10/1974 | Angibaud | 248/316 C X |
| 4,022,412 | 5/1977 | Houlf | 248/316 C X |
| 4,225,106 | 9/1980 | Eplan | 248/282 X |
| 4,307,864 | 12/1981 | Benoit | 248/221.3 |

*Primary Examiner*—J. Franklin Foss
*Assistant Examiner*—David L. Talbott
*Attorney, Agent, or Firm*—Clifton Ted Hunt

[57] ABSTRACT

A two-part holder for an appliance, such as a manually operable hairdryer, includes a stationary wall mounted bracket as one part and a relatively movable appliance clamping portion as the other part. The clamping portion may be clamped about an appliance and quickly connected to and quickly removed from the stationary bracket without manipulating any fastening mechanism. An abutment projecting from the bracket retains the electric supply cord of an appliance out of the user's way.

6 Claims, 10 Drawing Figures

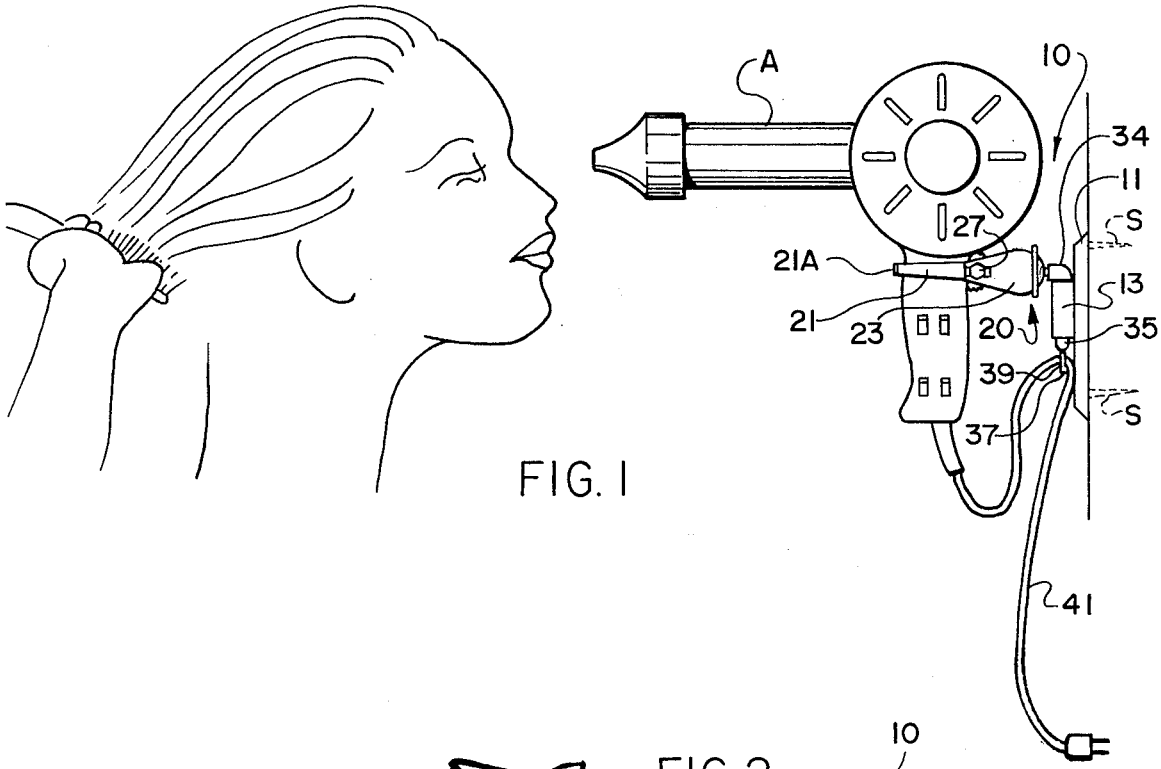
FIG. 1
FIG. 2
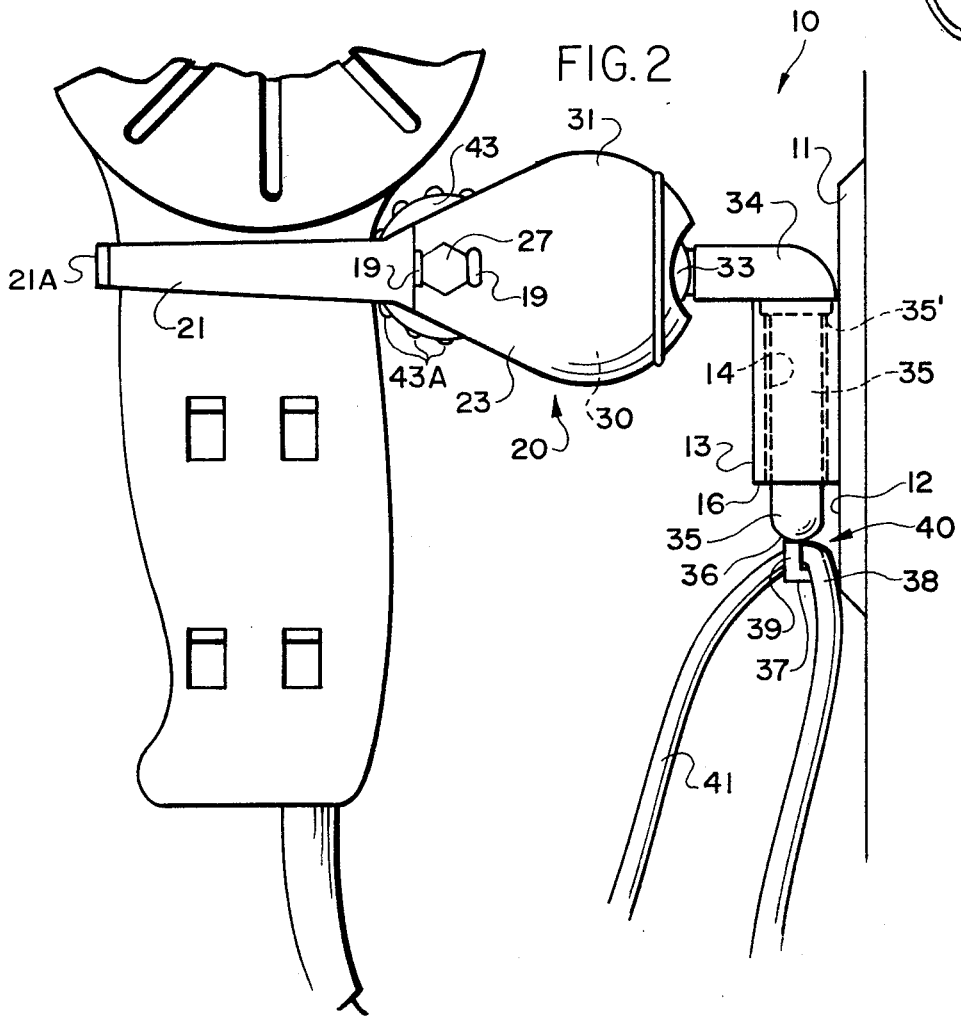

FIG. 3
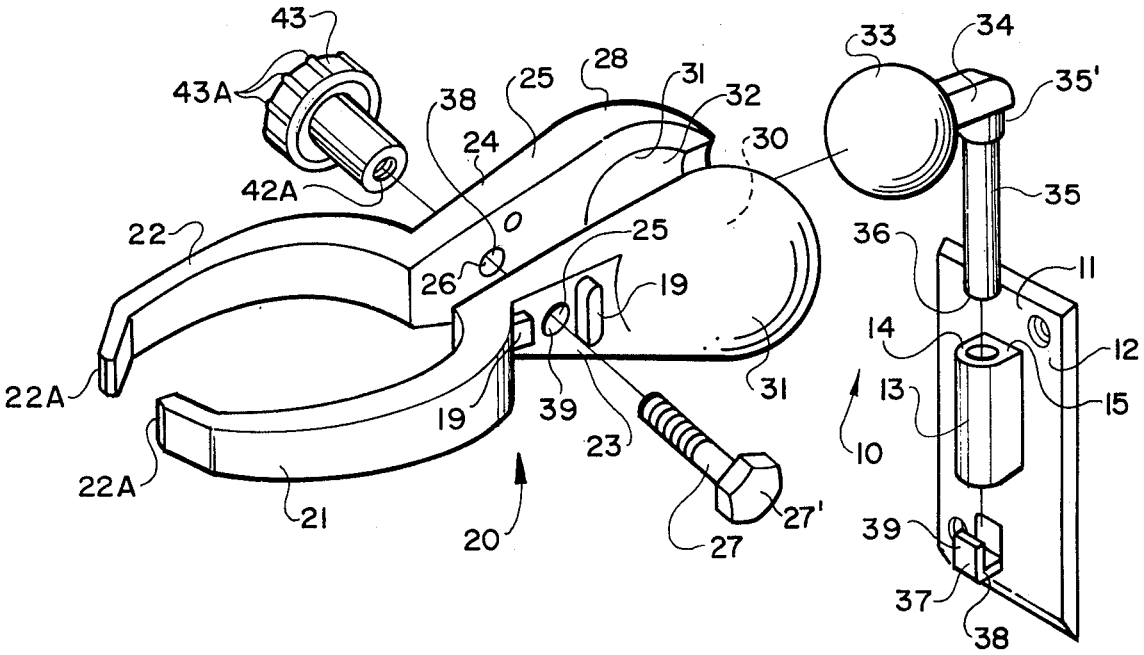
FIG. 4
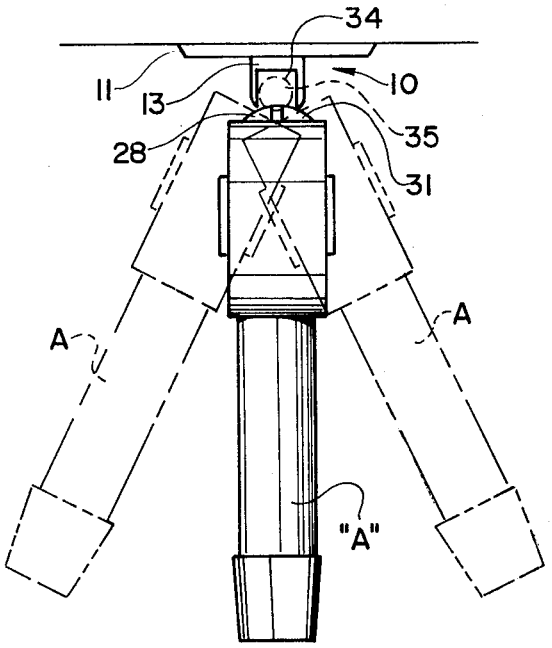
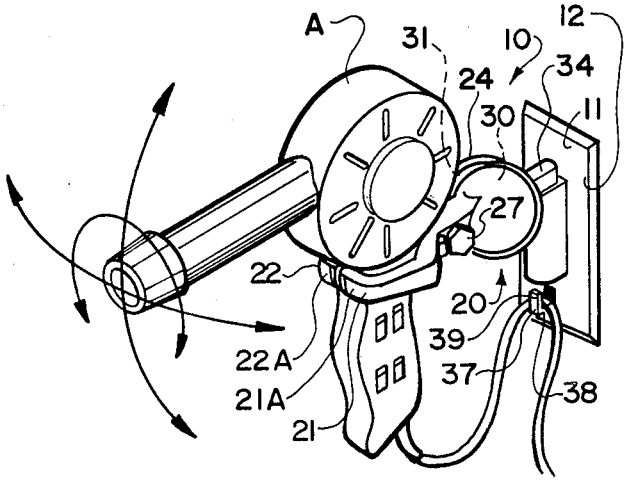
FIG. 5

FIG. 9
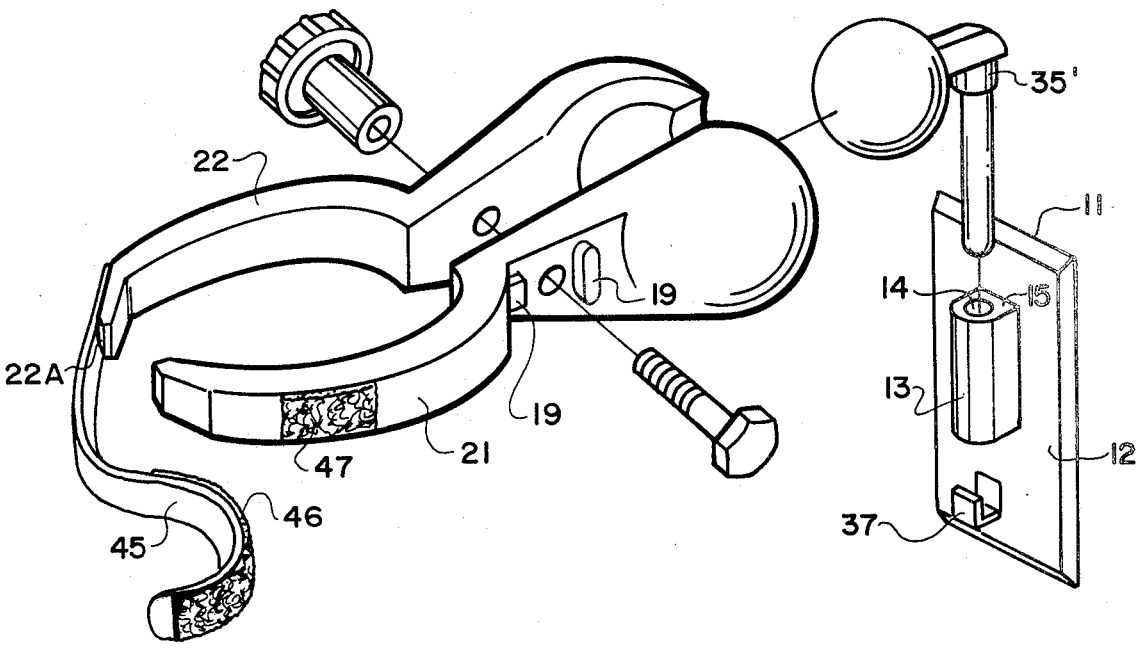
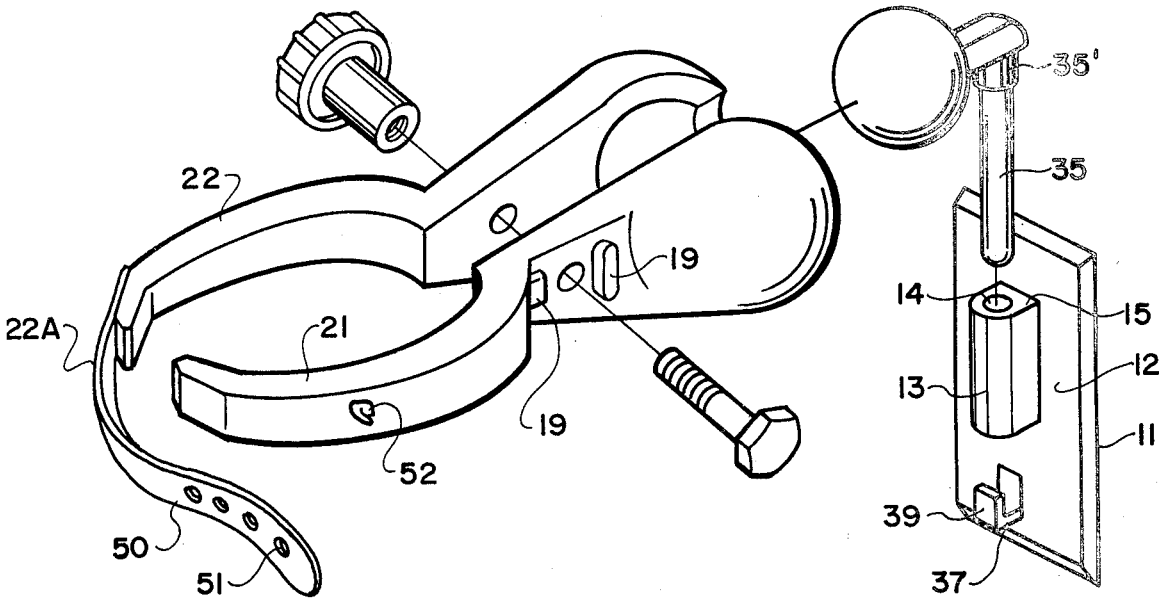
FIG. 10

APPLIANCE HOLDER

BACKGROUND OF THE INVENTION

Holders for appliances and the like have long been known, including holders mounted on a stationary support and engagable with an appliance or the like for supporting the appliance in a desired adjustable position relative to the stationary support. For example, U.S. Pat. No. 2,029,532 to Karcher discloses an adjustable lamp support including a bracket rigidly attached to a vertical wall and universal joints between the rigid bracket and the lamp to enable adjustment of the lamp to a desired attitude relative to the rigid bracket and the supporting wall. See also U.S. Pat. Nos. 1,300,863 to Otte, 908,751 to Cooke and Swiss Pat. Nos. 161,459 to Leinigen and 161,330 to Reymond.

These patents illustrate adjustable appliance holders, but none of the prior art known to applicant teaches or is in any way concerned with retention of the electric supply cord to keep it out of the way of the appliance user, nor does any of the prior art known to applicant teach a two-part holder, one part being rigidly attached to a supporting surface such as a vertical wall and the other part being releasably attached to the appliance, movable therewith and capable of being quickly and positively connected to said one part for support of the appliance, and easily removable from the support for manual handling of the appliance, when desired.

SUMMARY OF THE INVENTION

This invention relates to a holder for an appliance, such as an electric manually operable hairdryer, whereby the user is enabled to adjust the hairdryer to a desired position where the holder will retain it while the user has both hands free to brush or comb the hair while the appliance drys it. Of course, the holder may be used to support a wide variety of different types of appliances. The holder was two readily separable parts. One part is a support bracket rigidly attached as by screws to a wall. The other part is a universally adjustable clamp for attachment to and movable with the appliance. The clamp portion includes a stem loosely receivable within a vertically extending passageway on the bracket for support thereby, whereby the clamped appliance may be quickly supported by and removed from the supporting bracket, as desired. When the appliance is not in use, the stem can be rotated in the passageway to position the appliance to one side so that it is out of the way and substantially flush against a wall. This permits safe and out of the way storage of the appliance.

The support bracket includes an abutment, preferably of L-shaped configuration with a horizontal leg extending forwardly from the bracket beneath the vertically extending passageway on the bracket, and an upturned free end axially aligned with and extending toward the said vertical passageway. An electric supply cord for the appliance may be retained out of the user's way by placing the cord on the horizontal leg and behind the upstanding free end. The cord may be positively retained by the stem on the clamp portion when it is mounted in the vertical passageway on the bracket. The stem extends through the passageway and into engagement with or closely spaced relation to the abutment and positively prevents removal of the cord from the abutment until the stem is raised sufficiently to provide clearance for the cord above the abutment.

Therefore, it is an object of the present invention to provide a two-part appliance holder, one part being rigidly attached to a supporting surface and a second part being engagable with an appliance and movable therewith relative to said one part; and a quick release mechanism between the rigid part and the movable part permitting the movable part and its attached appliance to be quickly attached to and removed from the rigid part without manipulation of any fastening means.

It is another object of the present invention to provide an appliance holder of the type described which permits the appliance to be securely held while being adjustable about its lateral, vertical and horizontal axes.

It is yet another object of the present invention to provide an appliance holder which includes means for retaining an electric power supply cord of the appliance closely against the rigid support bracket to keep it out of the way of the user of the appliance.

BRIEF DESCRIPTION OF THE DRAWINGS

FIG. 1 is a side elevation of the appliance holder supporting a hairdryer in use;

FIG. 2 is an enlarged fragmentary side elevation with parts broken away, of the appliance holder and supported appliance shown in FIG. 1;

FIG. 3 is an exploded perspective view of the appliance holder with the appliance removed;

FIG. 4 is a top plan view showing an appliance in the appliance holder and illustrating by dotted line positions pivotal adjustment of the appliance about a vertical axis;

FIG. 5 is a perspective view of an appliance in the holder and illustrating that the appliance may be pivoted about horizontal axes;

FIGS. 9 and 10 are exploded, perspective views illustrating further modified forms of the invention, which provide additional means for securing the appliance to the appliance holder.

DETAILED DESCRIPTION OF THE INVENTION

Figure 8:
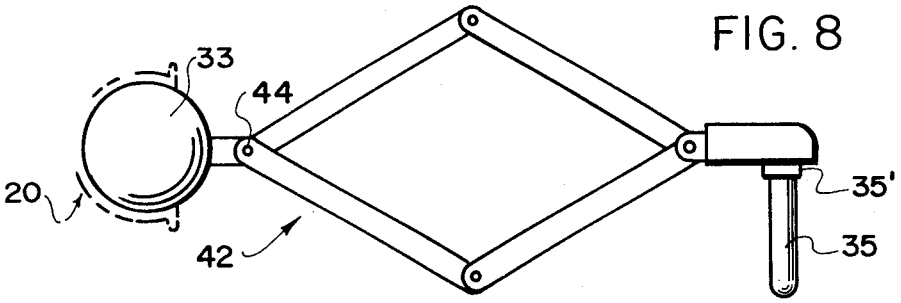
FIG. 8 is a side elevation of a fragmentary portion, with parts broken away, of the clamping portion illustrating a modified form which enables the appliance to be adjustably extended outwardly from its supporting bracket.

Referring more specifically to the drawings, the appliance holder is broadly indicated at 10 and an appliance, such as a manually operable electric hairdryer A is held by the appliance holder 10 is an adjustably desired position during use. It is apparent that the appliance A need not be a hairdryer and that the holder 10 can be used to hold a wide variety of appliances and other devices.

Appliance holder 10 includes a first component comprising a bracket 11 which can be secured to a supporting surface, such as a wall, as by screws S. The bracket 11 includes an outer surface 12 having formed integral therewith a tubular flange 13 which extends longitudinally of the bracket 11 and vertically in use as shown in the drawings. The tubular flange 13 has a bore or passageway 14 extending therethrough and communicating with the upper wall 15 and lower wall 16 of tubular flange 13.

The holder 10 includes a second component comprising a clamping portion broadly indicated at 20 and including arms 21 and 22 releasably engagable with an appliance A. The arms 21 and 22 are curved so that their outer ends 21*a* and 22*a* approach each other to substantially encircle the appliance A in assembled relation. The other or inner ends of arms 21, 22 are joined to and preferably formed integral with respective socket portions 23 and 24. The socket portions 23, 24 each have a transverse bore 25 and 26, respectively, extending therethrough and the bores 25 and 26 are aligned in use and penetrated by a threaded bolt 27 engagable with a manually operable nut 28 to selectively clamp and release the arms 21, 22 about the appliance A. The manipulation of the nut 28 is facilitated in use by providing a hexagonal head 27' on the bolt 27 and seating the head 27' between bosses 19 spaced on opposite sides of the bore 25 through socket portion 23. So seated, the bolt 27 is firmly held against rotation during manipulation of the nut 28, thereby facilitating adjustment of the appliance.

The socket portions 23, 24 each terminate at their ends opposite arms 21, 22 in hemispherical cavities 30 and 31, respectively, which combine when assembled for use in the positions shown in FIG. 3 to form a socket 32 (FIG. 3). The clamping portion 20 also includes a spherical ball 33 receivable in socket 32 and held firmly by the hemispherical cavities 30 and 31 when the nut 28 is rotated to draw the arms 21 and 22 together. By appropriate adjustment of the nut 28 the arms 21, 22 and the appliance A held thereby may be rotated relative to the ball 33 to a desired position and retained there by tightening the nut 28 on the bolt 27. A mounting arm 34 projects from the ball 33 in a direction opposite the clamping portion 20 in FIG. 3 and a stem 35 depends in angular relation from the arm 34.

The stem 35 is loosely received within the bore or passageway 14 to provide a convenient quick-release attachment of the clamping portion 20 to the wall mounted bracket 11 and enable the user of the appliance, such as a hairdryer, to manually lift the appliance from the bracket and direct it as desired without having to disengage the clamping mechanism holding the appliance to the clamping portion 20. The structural arrangement of the invention also enables a user to quickly and conveniently reattach the clamping portion to the bracket by simply inserting the free end 36 of stem 35 into the upper end and conveniently reattach the clamping portion to the bracket by simply inserting the free end 36 of stem 35 into the upper end of the passageway 14 communicating with the top wall 15 of tubular flange 13. The free end portion 39 of the abutment 37 is spaced from the surface 12 of bracket 11 to define a space indicated at 40 in FIG. 2. The spacing of the free end 39 from the bracket 11 is sufficient to accomodate the diameter of an electric supply cord 41 extending from the appliance A to a source of power, not shown.

Figure 6:
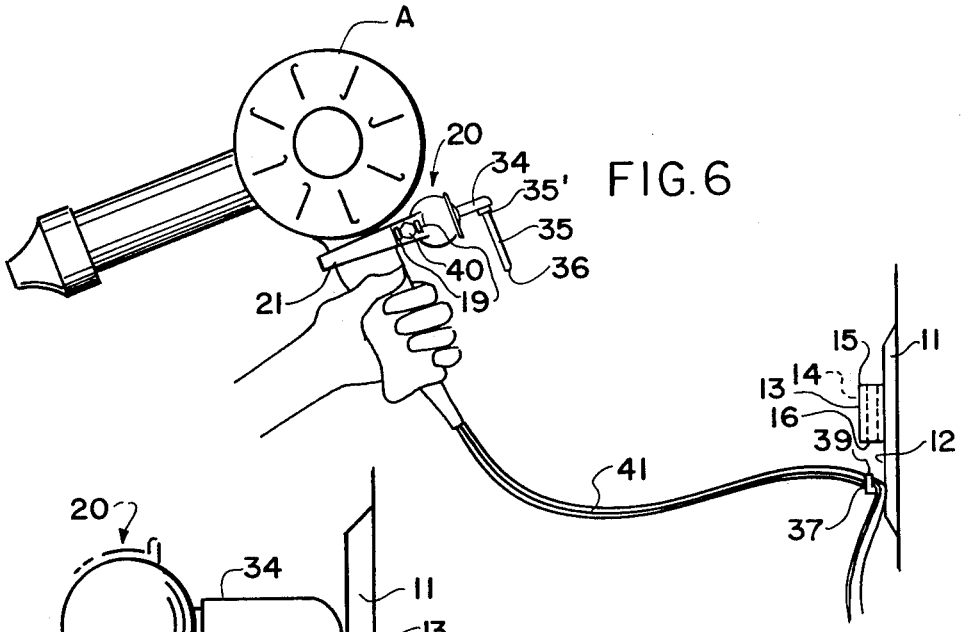
FIG. 6 is a side elevation of the two part appliance holder showing the clamping portion attached to an appliance and removed from the supporting bracket fastened to a wall.

The stem 35 is preferably longer than the passageway 14 with the free end 36 terminating against or closely adjacent the abutment 37, leaving a space less than the diameter of the electric supply cord 41 when the stem is fully seated in passageway 14 with its arm 34 supported by the upper wall 15 of flange 13. The cord 41 may be passed over the free end portion 39 and laid on the horizontal arm 38 of the abutment 37 when the stem 35 is drawn upwardly a sufficient distance or removed from the passageway 14 as shown in FIG. 6. The upstanding free end portion 39 normally retains the cord 41 but the cord 41 is positively retained in the abutment 37 when the stem 35 is positioned in the flange 13 so that the free end portion 36 of the stem 35 extends into engagement with or into closely spaced relation to the abutment 37 as shown in FIG. 2. After a user of the appliance has removed the clamping portion 20 from the flange 13 and thereby removed the stem 35 from the abutment 37, the user may, if desired, remove the cord 41 by lifting it over the upstanding free end 39 of the abutment.

It has been noted that the stem 35 fits loosely within the passageway 14. This is for the purpose of enabling the clamp portion and its attached appliance to be quickly and easily attached to and removed from the bracket 11. The free end 36 of the stem is desirably rounded to facilitate its insertion in the passageway 14. By way of illustration only and not as a limitation, it is noted that one operable embodiment of the invention has a passageway 14 with 0.384 inches (9.75 mm) inside diameter and a stem 35 with an outside diameter of 0.356 inches (9 mm). This provides a desirably loose fit to perform the quick-release function described above.

The stem 35 has an annular collar 35' at its juncture with the mounting arm 34. The collar 35' is of slightly larger diameter than the stem 35 so that the lower edge of the collar is supported on the upper wall 15 of flange 14 when the stem 35 is seated in the tubular passageway by gravity alone. But when a moderate amount of downward pressure is applied axially of the stem 35, the collar 35' is moved past the upper wall 15 and into snug engagement with the wall of the passageway 14. For example, the operable embodiment described above has a collar 35' with an outside diameter of 0.394 inches (10 mm), which is snugly receivable within the passageway 14 with its 9.75 mm inside diameter. The snug fit is useful in retaining the appliance in a desired adjusted position but can be overcome by the application of moderate upward pressure against the clamping portion 20 or mounting arm 34 to remove the stem 35 from the passageway 14.

Figure 7:
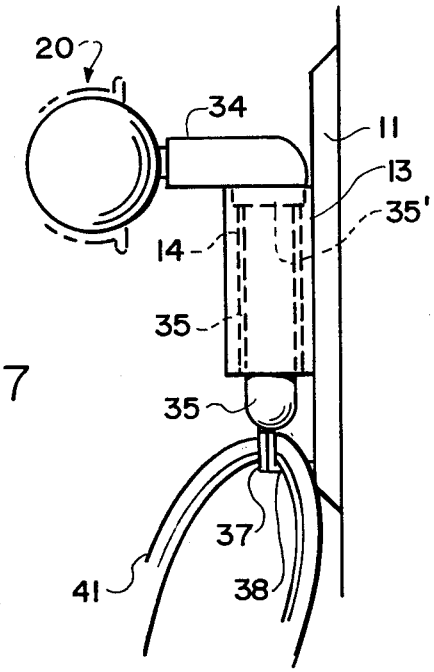
FIG. 7 is a fragmentary side elevation, with parts broken away, of a modified form of the invention, utilizing a straight abutment in combination with the stem on the clamping portion to retain an appliance cord.

It will be noted in FIGS. 2 and 6 that the passageway 14 is spaced from the surface 12 of bracket 11 and according to an alternate embodiment of the invention the abutment 37 consists only of the horizontal leg 38 which acts with the stem 35 to retain the cord 41 when the stem is fully seated in the flange 13 with the free end 36 of the stem engaging or closely adjacent the abutment 37 as shown in FIG. 7.

Referring now to FIG. 8, the rigid arm 34 extending between the vertical stem 35 and the ball 33 may be replaced by an extensible linkage broadly indicated at 42 pivotally connected as at 43 and 44 to the stem 35 and the ball 33. With this arrangement the appliance may be easily pulled away from the supporting bracket 11 without disconnecting the clamping portion 20 from the bracket 11.

FIG. 9 illustrates a further modification wherein the clamping capability of the clamp arms 21 and 22 is enhanced by a strap 45 extending from the free end 22*a* of clamp arm 22. The free end of strap 45 has on its inner surface a plurality of hook-like portions generally indicated at 46 and engagable with an anchor strip of non-woven material 47 on the outer surface of arm 21. The strap 45 may be tightened around an appliance and and retained by engagement of the strips 46 and 47, known in the trade as VELCRO.

FIG. 10 illustrates another embodiment of the invention utilizing a strap 50 provided with holes 51 spaced longitudinally along its free end portion, a desired hole being selectively engagable with a hook 52 extending outwardly from the clamp arm 21.

The straps illustrated in FIGS. 9 and 10 may be useful in holding bulky appliances or industrial tools which cannot be securely clamped by the arms 21, 22.

There is thus provided a holder for appliances which enables free use of the user's hands while the appliance is retained in operative position to perform a desired function, such as drying hair. According to the invention the user of the appliance may remove the appliance with the clamping portion from the retaining bracket and hold the appliance manually, when desired, and may then return the appliance to the retaining bracket by inserting the stem into the supporting flange. There is no need for adjustment or manipulation of anything to release or retain the appliance on the bracket.

The electric supply cord for the appliance may, if desired, be retained on the bracket so as to be out of the way of the user and the user may easily remove the cord from the bracket by lifting it from the abutment after the appliance has been removed from the bracket.

In the drawings and specification there has been set forth preferred embodiments of the invention and although specific terms have been employed they have been used in a descriptive sense only and not for purposes of limitation.

I claim:

1. A holder for releasably attaching an appliance having an electric supply cord to a vertical support surface comprising (a) a support bracket;

(b) means for attaching the support bracket to a vertical supporting surface;

(c) a flange projecting from one surface of the support bracket and having a tubular opening extending vertically and communicating with the upper and lower surfaces of the flange;

(d) a clamping portion releasably engageable with the appliance;

(e) a stem extending from the clamping portion and loosely receivable within the tubular opening;

(f) the stem being of greater length than the distance between the upper and lower surfaces of the flange and including a free end portion extending beyond the lower surface of the flange when the stem is fully seated in the tubular opening;

(g) an abutment extending from said one surface of the support bracket beneath the flange; and (h) the abutment extending into the path of the free end portion of the stem and into sufficiently close proximity to the free end of the stem that the stem will releasably retain an electric supply cord supported on the abutment between the stem and the support bracket.

2. A structure according to claim 1 wherein the abutment is L-shaped.

3. A structure according to claim 1 wherein said clamping portion includes a pair of clamp arms movable relative to each other to clamp an appliance and means for retaining the clamp arms in clamping relation about an appliance.

4. A structure according to claim 3 wherein said means for retaining the clamp arms in clamping relation about an appliance comprises a threaded bolt penetrating both clamp arms, a nut threadably engageable with the bolt and with one clamp arm, a pair of bosses on the other clamp arm spaced from each other on opposite sides of the bolt, and an angularly shaped head formed integral at the end of the bolt opposite the nut and seated between the bosses to prevent rotation of the bolt during manipulation of the nut.

5. A structure according to claim 1 wherein a flexible strap extends from the free end of one clamp arm and means for retaining the flexible strap is engagement with the other clamp arm.

6. A structure according to claim 1 wherein the clamping portion includes an extensible linkage.

* * * * *